US005161620A

United States Patent [19]

Ritter, Jr.

[11] Patent Number: 5,161,620

[45] Date of Patent: Nov. 10, 1992

[54] SUBSEA PRODUCTION WELLHEAD ASSEMBLY

[75] Inventor: Paul B. Ritter, Jr., Slidell, La.

[73] Assignee: Shell Offshore Inc., Houston, Tex.

[21] Appl. No.: 722,432

[22] Filed: Jun. 27, 1991

[51] Int. Cl.[5] ..... E21B 17/01

[52] U.S. Cl. ..... 166/359; 166/367; 166/368

[58] Field of Search ..... 166/345, 359, 360, 366, 166/367, 368

[56] References Cited

U.S. PATENT DOCUMENTS

| | | | |
|---|---|---|---|
| 3,189,097 | 6/1965 | Haeber | 166/359 |
| 4,068,729 | 1/1978 | Peevey | 166/359 X |
| 4,363,567 | 12/1982 | Van der Graaf | 166/367 X |
| 4,770,247 | 9/1988 | Wilkins | 166/359 X |

*Primary Examiner*—William P. Neuder

[57] ABSTRACT

A concentric riser parallel bore subsea well assembly for controlling production from a subsea wellhead to a floating production facility. The invention utilizes a concentric riser and tubing string in combination with a dual parallel bore production tree. The production tree communicates with a parallel bore tubing hanger that communicates with the production tubing string and the casing annulus.

5 Claims, 1 Drawing Sheet

FIG. 1
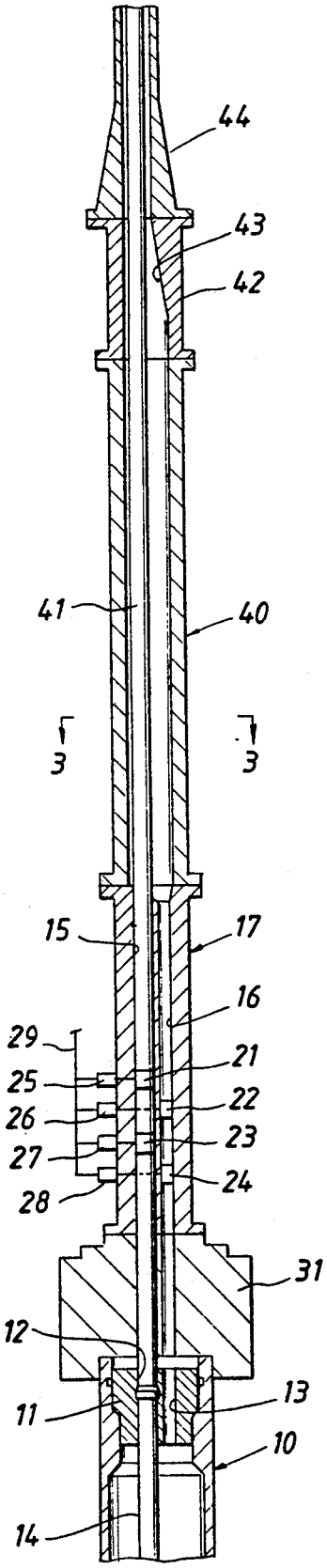
FIG. 3
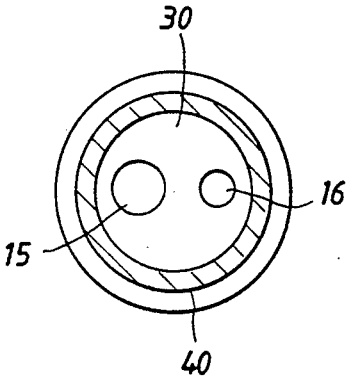
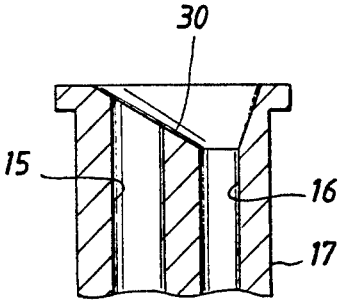
FIG. 4
FIG. 2
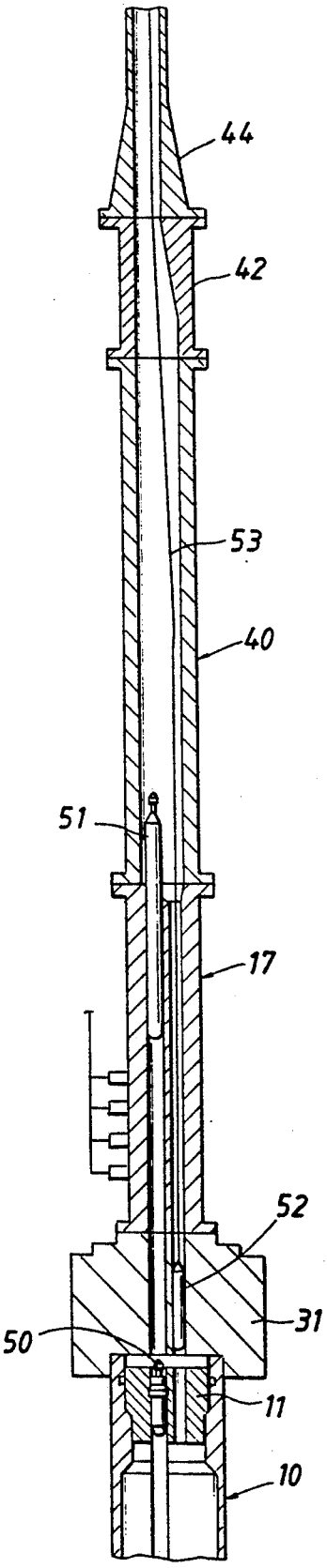

SUBSEA PRODUCTION WELLHEAD ASSEMBLY

BACKGROUND OF THE INVENTION

The present invention relates to offshore producing platforms and particularly to platforms that are limited as to the amount of currentinduced drag they can withstand and the suspended weight they can support. All floating production platforms that can be installed in deep water have this limitation including moored, tension leg, and guide tower type platforms.

In many offshore producing wells it is desirable to use a dual bore subsea production tree so that controlled access is available to both the production tubing and to the annulus surrounding the production tubing which extends into the well. By having controlled access to both the production tubing and the annulus surrounding the production tubing, it is possible to fill the well with weighted drilling mud to kill the well when it is necessary to remove the production tubing for workovers or other operations in the well. In the absence of separate controlled access to the annulus, the production tubing string must be used to introduce weighted drilling mud into the well to control the well so that the production tubing string could be removed. This is not desirable since the production fluid flowing in the tubing string will be under pressure and thus the operations must be conducted under the pressure. In contrast, if one has direct access to the annulus surrounding the production tubing string, there will be no need to contend with the production fluid flowing in the tubing string while the well is being killed.

While dual bore tubing hangers and dual bore subsea production trees are available, they require the use of separate tubing strings in the two bores. In addition, both of the tubing strings must be enclosed within a marine riser that extends from the wellhead to the surface platform. This requires that the surface platform be capable of supporting the suspended weight of the two tubing strings plus the marine riser.

SUMMARY OF THE INVENTION

The present invention reduces both the size of the tubular members and weight that must be supported by the platform by eliminating the need for one of the tubing strings that have been utilized in the prior art dual subsea production trees. The present invention accomplishes this by using a dual, parallel bore tubing hanger which is positioned in either the top of the well casing or a separate tubing hanger spool. The production tubing is supported by one of the bores in the tubing hanger and extends down to the producing formation. The second bore in the tubing hanger communicates directly with the annulus surrounding the production tubing. The production tree also has dual parallel bores which are aligned with the bores in the tubing hanger so that the produced fluids can flow from the production tubing string through the production tree to the tubing string or flowline that extends from the production tree to the surface platform. The production tree is secured to the top of the well casing by a suitable hydraulic or mechanical locking means.

The top of the production tree is coupled to a riser spool whose internal diameter corresponds to the combined diameters of the production tree bores. The riser spool is coupled to a second riser spool which is provided with a transition surface which converts the internal diameter of the riser spool to the diameter of the marine riser that extends from the subsea well assembly to the surface platform. If desired, both of the riser spools can be combined in a single riser spool. The production tubing string extends through the riser and through the two riser spools and is coupled to one of the bores at the top of the production tree. The annulus in the marine riser communicates with the annulus in the riser spools and the other bore in the production tree.

The present wellhead system thus provides controlled fluid communication between the well annulus and the annulus surrounding the production tubing in the marine riser, the production tubing string in the well and the production tubing in the riser. This allows the well to be killed using the riser annulus and the casing annulus and eliminates the need for a second tubing string between the wellhead and the surface platform.

While the invention is described as using a single tubing string and the well annulus, it can be used with two or more tubing strings and the well annulus. An important feature of the invention is that it allows plugging of all the tubing bores and well annulus before removing the subsea well tree. Thus, the tree can be safely removed and a blowout preventer installed before starting a workover operation. Another feature of the invention is the use of a dual bore wellhead tree that allows the use of conventional valves to shut off the well annulus. Prior art systems relied on annular valves for shutting off the well annulus.

BRIEF DESCRIPTION OF THE DRAWINGS

The present invention will be more easily understood from the following description when taken in conjunction with the attached drawings in which:

FIG. 1 is an elevation view of the subsea well assembly of the present invention, showing the production tubing in place.

FIG. 2 is an elevation view with the production tubing removed and a plug installed in the production tubing in the well hanger and a second plug being installed in the well annulus.

FIG. 3 is a cross section taken along line 3—3 of FIG. 1 to an enlarged scale.

FIG. 4 is an enlarged elevation section of the top of the production tree shown in FIGS. 1 and 2.

DESCRIPTION OF PREFERRED EMBODIMENTS

Referring now to FIGS. 1 and 2, there is shown in elevation views of the present invention with the production tubing installed in FIG. 1 and removed in FIG. 2. The dual parallel bore tubing hanger 11 is supported from the top of the casing string 10 as shown in the drawings. The dual bore tubing hanger is a conventional tubing hanger and is supported from the load surface which projects inwardly from the top of the casing hanger 10. The tubing hanger is provided with a bore 12, from which the production tubing 14 is suspended, and a second bore 13. The production tubing extends downwardly into the well to the producing zone of the well while the second bore 13 communicates directly with the annulus that surrounds the production tubing 14. A production tree 17 is secured by a connector means 31 that secures the production tree to the top of the well casing. The connector means 31 may be hydraulically operated with the actuation being supplied by either hydraulic lines connected to the connector and extending to the surface or by means of a remotely operated vehicle (ROV).

The production tree is provided with dual parallel bores 15 and 16 that are aligned with the bores that extend through the connector 31 and the bores in the tubing hanger 11. A series of valves 21-24 are provided for controlling the flow in the bores 15 and 16 of the production tree. The valves are operated by suitable hydraulic means 25-28 that are selectively supplied with hydraulic fluid through a bundle of hydraulic lines 29 that extend to the surface or a local hydraulic control pod. In the alternative, the valves can be individually operated by a remotely operated vehicle or diver. The production tree 17, connector 31, and the dual bor tubing hanger 11 are all commercially available units that are supplied by various manufacturers, for example, Cameron Iron Works or Vetco-Gray Hughes, both of Houston, Tex., for use on marine wellheads.

As seen in FIG. 4, the top of the production tree may be provided with an inclined conical shaped surface 30. The conical surface is so positioned that it will assist in directing an elongated member such as a plug that is to be installed in the bore 13 of the tubing hanger 11 or a similar member into the bore 16 of the production tree. As is seen in FIG. 3, the bore 16 is normally smaller than the bore 15 in which the production tubing 41 is installed.

The top of the production tree is coupled to a riser spool 40 which has substantially the same internal diameter as the overall internal diameter of the production tree 14. The top of the riser spool 40 is coupled to a riser spool transition member 42 which converts the internal diameter of the riser spool 40 to the diameter of the marine riser 44. This transition surface 43 is in the form of a semi-conical surface as shown in FIG. 1. The marine riser couples to the top of the transition member 42 and extends from the subsea wellhead to the surface. The production tubing string 41 is positioned within the marine riser and also extends to the surface platform. As seen in the Figure, the annular area surrounding the tubing string 41 in the marine riser communicates with the annular area that surrounds the tubing string 14 in the well by means of the bore in the production tree 44 and similar bores in the hydraulic connector 31 and the bore 13 in the tubing hanger installed in the well. While the riser spool 40 is shown as having a circular cross section, it could have an oval cross section that would assist in directing a plug into the bore 16 as described below.

Referring to FIG. 2, there is shown a plug 50 installed in the bore 12 of the tubing hanger and a diverter plug 51 installed in the top of the bore 15 in the production tree. Also shown is a second plug 52 which is lowered by a wireline 53 through the production tree and is to be installed in the second bore 13 of the tubing hanger. When the two plugs are installed, the hydraulic connector 31 may be operated to release the production tree and remaining riser equipment from the top of the well casing. The equipment can then be withdrawn to the surface for maintenance or other operations.

When the system is to be re-installed, the hydraullic connector, the production tree, and the two riser spools 40 and 42, are made up at the surface and attached to the transition joint 44 of the marine riser. This equipment can then be run and secured to the top of the well casing 10 by operation of the hydraulic connector. After the marine riser and related equipment are in place the wireline 53 may be run in the riser and used to remove the plug 52 from the bore 13 of the tubing hanger. After the plug is removed, the diverter plug 51 may be removed with the wireline and the second plug 50 may also be removed. After the plugs are removed, the production tubing 41 can be run through the marine riser and connected to the top of the production tree.

The above procedure can be reversed when it is desired to remove the production tubing from the wellhead assembly and remove both the production tree and the marine riser and associated equipment from the well.

When the system is to be used to kill the well, the heavy kill fluid or drilling mud can be pumped down the production tubing string while the well fluid is vented through the annulus. After the well is killed, the plugs described above can be inserted and the wellhead tree removed. Likewise, workover operations can be conducted through the production tubing string and marine riser.

From the above description, it is apparent that the present invention has eliminated one tubing string and reduced the overall diameter of the marine riser used in conventional dual tubing string systems. This reduces both the weight that the platform must support and the strain induced by current flow past the marine conductor. This permits the use of smaller platforms and results in reduced cost.

What is claimed is:

1. A subseas well assembly for controlling production from subsea well to a floating production facility, comprising:

a marine riser, said marine riser extending from said floating production facility to said well;

at least one production tubing string, said tubing string extending from said floating production facility through said marine riser to said well;

a remotely operated subsea production tree, said production tree having at least two parallel bores;

a multiple bore tubing hanger, the number of bores being equal to the number of bores in said production tree, said hanger being positioned in the top of the casing in said subsea well, said production tree being installed on said casing with the parallel bores in communication with the parallel bores in said tubing hanger; and a riser spool, the lower end of said riser spool being coupled to said production tree and the upper end of said riser spool being coupled to said marine riser, said riser spool having an interior cross section corresponding to the upper cross section of said production tree.

2. The subsea well assembly of claim 1 and, in addition, a transition spool for coupling the upper end of the riser spool to the marine riser.

3. The subsea assembly of claim 1 wherein said riser spool includes a portion adjacent its upper end that acts as a transition surface from the cross section of said production tree to the cross section of said riser.

4. The subsea assembly of claim 1 wherein the upper end of said production tree is provided with a guide surface for guiding a member into one of the bores of said production tree.

5. The subsea assembly of claim 4 and, in addition, a diverting member, said diverting member being inserted in the other of the bores in said production tree to assist in directing a member into said one of the bores in said production tree.

* * * * *